US006674027B2

(12) United States Patent
Kowalyshen et al.

(10) Patent No.: US 6,674,027 B2
(45) Date of Patent: Jan. 6, 2004

(54) OPERATING ARRANGEMENT FOR MECHANISM

(75) Inventors: Henry W. Kowalyshen, Niles, IL (US); Andrew C. Shum, Des Plaines, IL (US); John C. Opfer, Chicago, IL (US)

(73) Assignee: S&C Electric Co., Chicago, IL (US)

( * ) Notice: Subject to any disclaimer, the term of this patent is extended or adjusted under 35 U.S.C. 154(b) by 0 days.

(21) Appl. No.: 10/139,805

(22) Filed: May 3, 2002

(65) Prior Publication Data

US 2003/0213681 A9 Nov. 20, 2003

Related U.S. Application Data

(63) Continuation of application No. PCT/US00/30470, filed on Nov. 3, 2000.

(60) Provisional application No. 60/165,416, filed on Nov. 13, 1999.

(51) Int. Cl.[7] ..... H01H 27/00; H01H 9/28

(52) U.S. Cl. ..... 200/43.04; 200/43.08; 200/50.32; 200/337

(58) Field of Search ..... 200/17 R, 18, 200/43.11, 43.16, 43.19, 323, 337, 43.01, 48 P, 50.32, 50.39, 61.2, 61.21

(56) References Cited

U.S. PATENT DOCUMENTS 1,712,856 A * 5/1929 Thullen ..... 200/337
2,298,234 A * 10/1942 Rugg ..... 200/50.32

FOREIGN PATENT DOCUMENTS

DE 1143569 A * 2/1963
DE 2434438 * 1/1976
WO WO 01/37301 A14 * 5/2001

* cited by examiner

*Primary Examiner*—J. R. Scott
(74) *Attorney, Agent, or Firm*—James V. Lapacek

(57) ABSTRACT

An operating arrangement is provided for a mechanism or the like, e.g. an operating mechanism for a circuit interrupter for electrical power transmission and distribution systems where the operating mechanism operates on stored energy and requires a recharging operation after the stored energy is utilized to operate the circuit interrupter. The operating arrangement includes an operating member and a cooperating arrangement carried by the operating mechanism for retaining the operating member during a multi-turn charging operation. Initial operation of the operating member for one or more turns causes the operating member to be retained before any charging operation takes place. Subsequent operation of the operating member results in the charging of the operating mechanism. The operating member is then returned to an initial engagement position whereupon the operating member is released for removal from the operating mechanism. In a specific embodiment, an interlock function is also provided for the operating member, such that a key must be obtained from an associated device and inserted into the operating member before a recharging operation may begin for the operating mechanism. The key is inserted into the operating member and help captive therein before the operating member may be utilized to recharge the operating mechanism. In a specific implementation, the key is released from the associated device only when the associated device is locked in a particular operative state, e.g. a disconnect switch is locked open which releases the key for use in the operating member. Thus, while the key is held captive in the operating member during recharging operation, the disconnect switch cannot be operated.

10 Claims, 7 Drawing Sheets

OPERATING ARRANGEMENT FOR MECHANISM

This application is a continuation of International Application Number PCT/US00/30470 filed on Nov. 3, 2000 and claims the benefit of U.S. Provisional Application No. 60/165,416 filed on Nov. 13, 1999.

BACKGROUND OF THE INVENTION

1. Field of the Invention

The present invention relates generally to the field of operating devices for mechanisms and more particularly to an arrangement having an input that is operable via a tool or the like for recharging an operating mechanism for a protective device for electrical power transmission and distribution systems.

2. Description of the Related Art

Various operating tools and devices are known for selecting, controlling, sequencing and/or charging mechanisms, e.g. operating mechanisms for protective devices utilized in the electrical power transmission and distribution field. Some of these operating mechanisms include provisions for manual operation and/or recharging.

While the prior art arrangements may be useful to provide operating inputs for mechanisms, these prior arrangements do not provide a multi-turn charging input for a mechanism that retains the charging tool during the charging operation.

SUMMARY OF THE INVENTION

Accordingly, it is a principal object of the present invention to provide an operating arrangement for a mechanism or the like wherein an operating tool is retained during operation in a recharging operation for the mechanism that includes one or more turns of the operating tool.

It is another object of the present invention to provide an operating arrangement for charging a mechanism that retains an operating tool during the charging operation and that provides an interlock function for the operating tool.

It is a further object of the present invention to provide an interlock arrangement for an operating tool.

These and other objects of the present invention are efficiently achieved by the provision of an operating arrangement for a mechanism or the like, e.g. an operating mechanism for a circuit interrupter for electrical power transmission and distribution systems where the operating mechanism operates on stored energy and requires a recharging operation after the stored energy is utilized to operate the circuit interrupter. The operating arrangement includes an operating member and a cooperating arrangement carried by the operating mechanism for retaining the operating member during a charging operation that includes one or more turns of the operating member. Initial operation of the operating member for one or more turns causes the operating member to be retained before any charging operation takes place. Subsequent operation of the operating member results in the charging of the operating mechanism. The operating member is then returned to an initial engagement position whereupon the operating member is released for removal from the operating mechanism. In a specific embodiment, an interlock function is also provided for the operating member, such that a key must be obtained from an associated device and inserted into the operating member before a recharging operation may begin for the operating mechanism. The key is inserted into the operating member and held captive therein before the operating member may be utilized to recharge the operating mechanism. In a specific implementation, the key is released from the associated device only when the associated device is locked in a particular operative state, e.g. a disconnect switch is locked open which releases the key for use in the operating member. Thus, while the key is held captive in the operating member during recharging operation, the disconnect switch cannot be operated.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
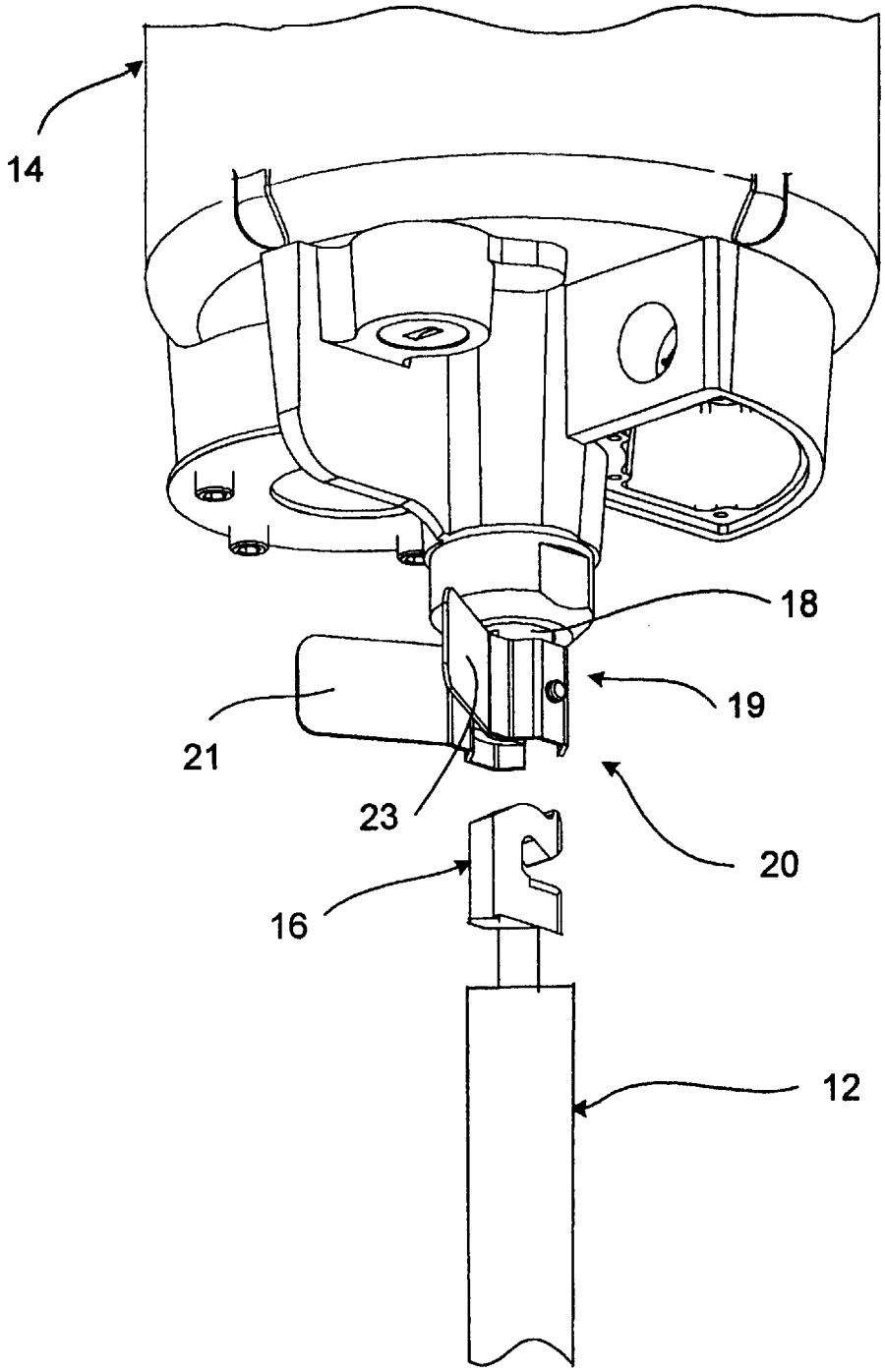
FIG. 1 is a perspective view of an operating arrangement in accordance with the present invention.

Referring now to FIG. 1, there is shown an illustrative embodiment of the present invention, an operating arrangement 10 having an operating input 20 that is operable via a tool 12, which may also be characterized as an operating member or device. In a specific illustrative example, the operating input 20 is utilized to charge a mechanism 14, e.g. the mechanism 14 is a stored-energy operating mechanism that operates a protective device (not shown) such as a circuit interrupter. For example, reference may be made to copending application serial no. (attorney docket reference Case SC-5328) for a more detailed discussion of an illustrative operating mechanism and circuit interrupter.

The tool 12 includes a predetermined fitting 16 that is manipulated to engage a cooperating arrangement of the mechanism 14 at the operating input 20, e.g. the cooperating arrangement may also be characterized as a charging port and is implemented in the illustrative embodiment by a clevis coupler member 18. The tool 12 is utilized to operate the mechanism 14, e.g. recharge the mechanism 14 with stored energy. In an illustrative embodiment, the operating input 20 includes a guiding member 19 having spaced apart arms 21, 23 that form an angle therebetween with the vertex at the clevis coupler member 18 for assisting in guiding the fitting 16 of the tool 12 into the charging port defined by the operating input 20.

Figure 2:
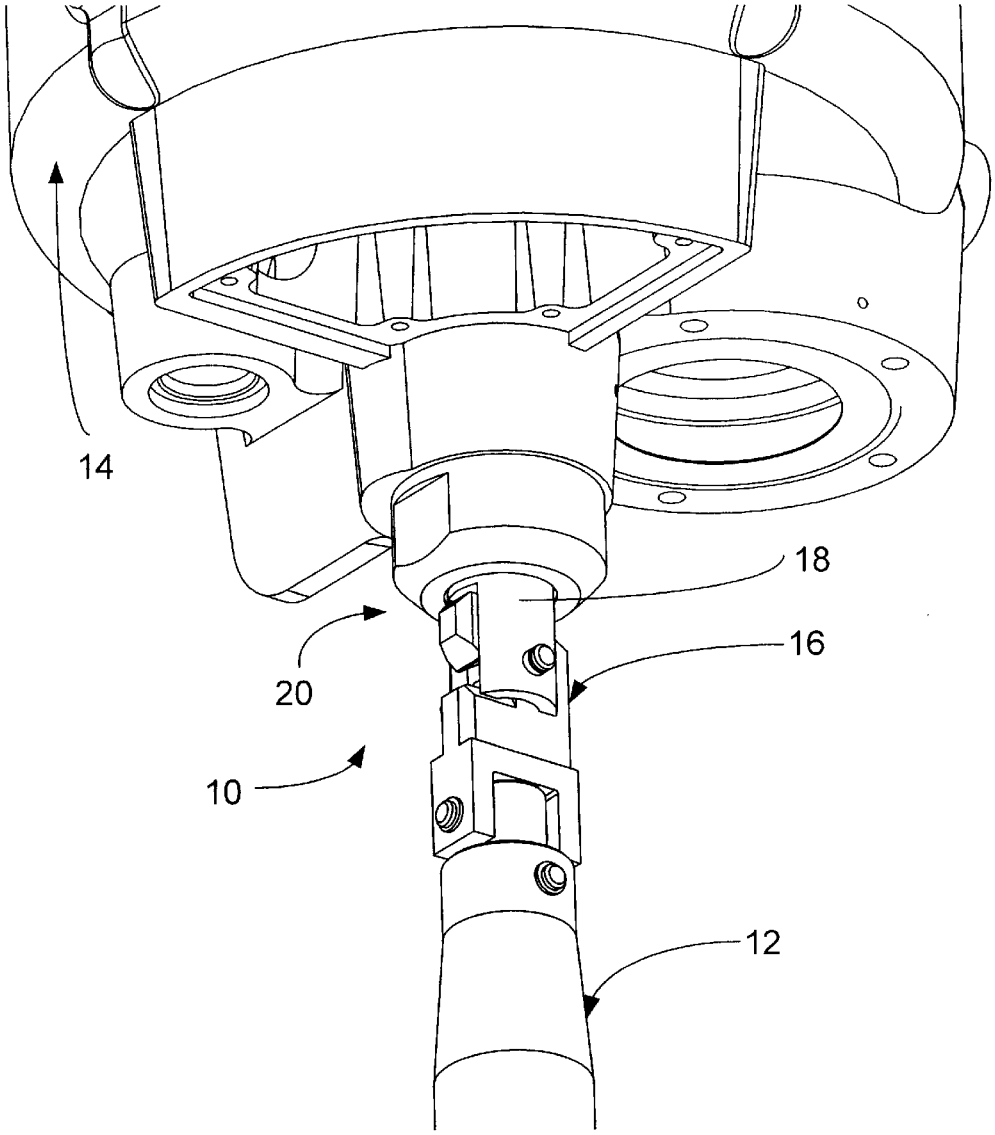
FIG. 2 is a perspective view of the operating arrangement of FIG. 1 in a first operating position.
Figure 3:
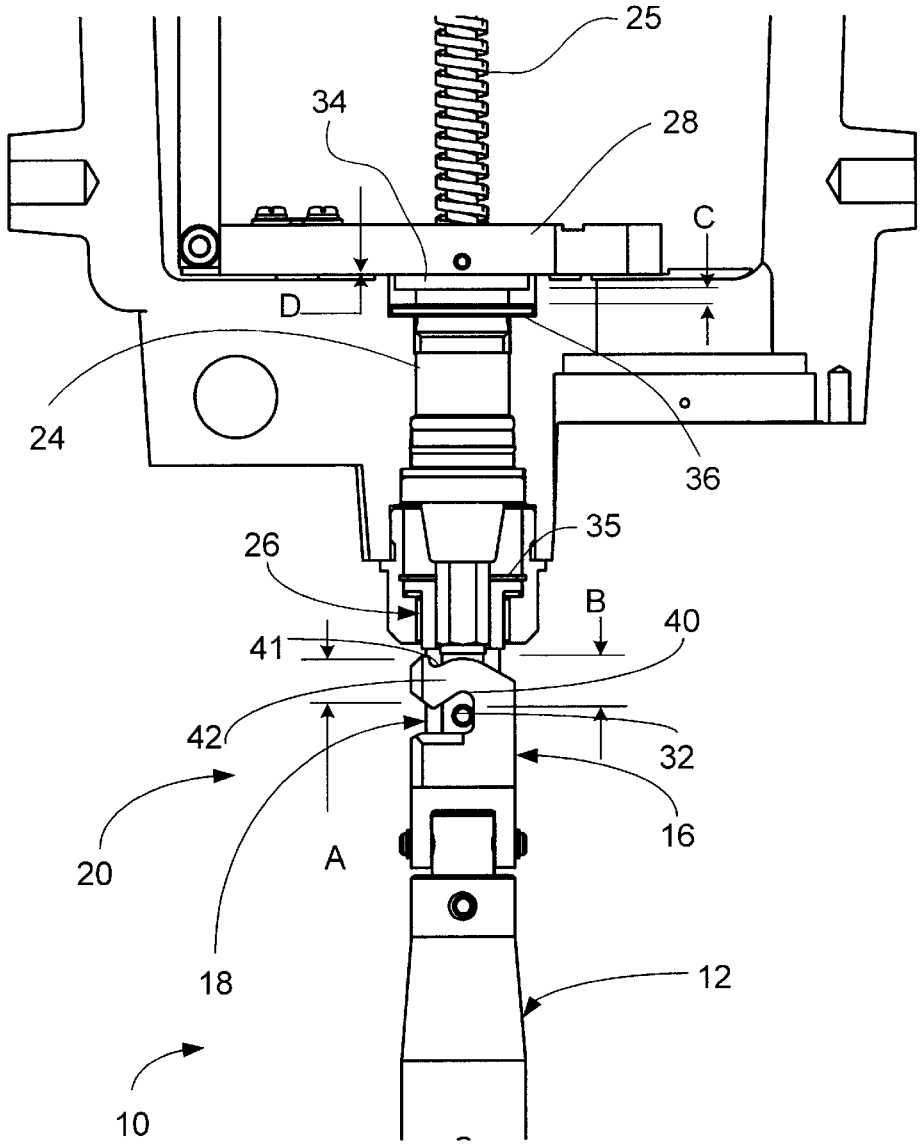
FIGS. 3–5 are right-side elevational views, partly in section and with parts cut-away and removed for clarity, of the operating arrangement of FIG. 2 illustrating various operating positions.

In accordance with important aspects of the present invention, while the tool 12 is being utilized to complete an operation, e.g. a charging operation, it is retained within the clevis coupler member 18 of the operating input 20 such that the tool 12 is captive and cannot be removed until the mechanism 14 is charged and/or until the operating arrangement 10 is fully operated and the tool 12 returned to an initial starting position for removal. Referring now additionally to FIGS. 2 and 3, in a first predetermined position illustrated, the tool 12 engages the clevis coupler member 18.

Figure 4:
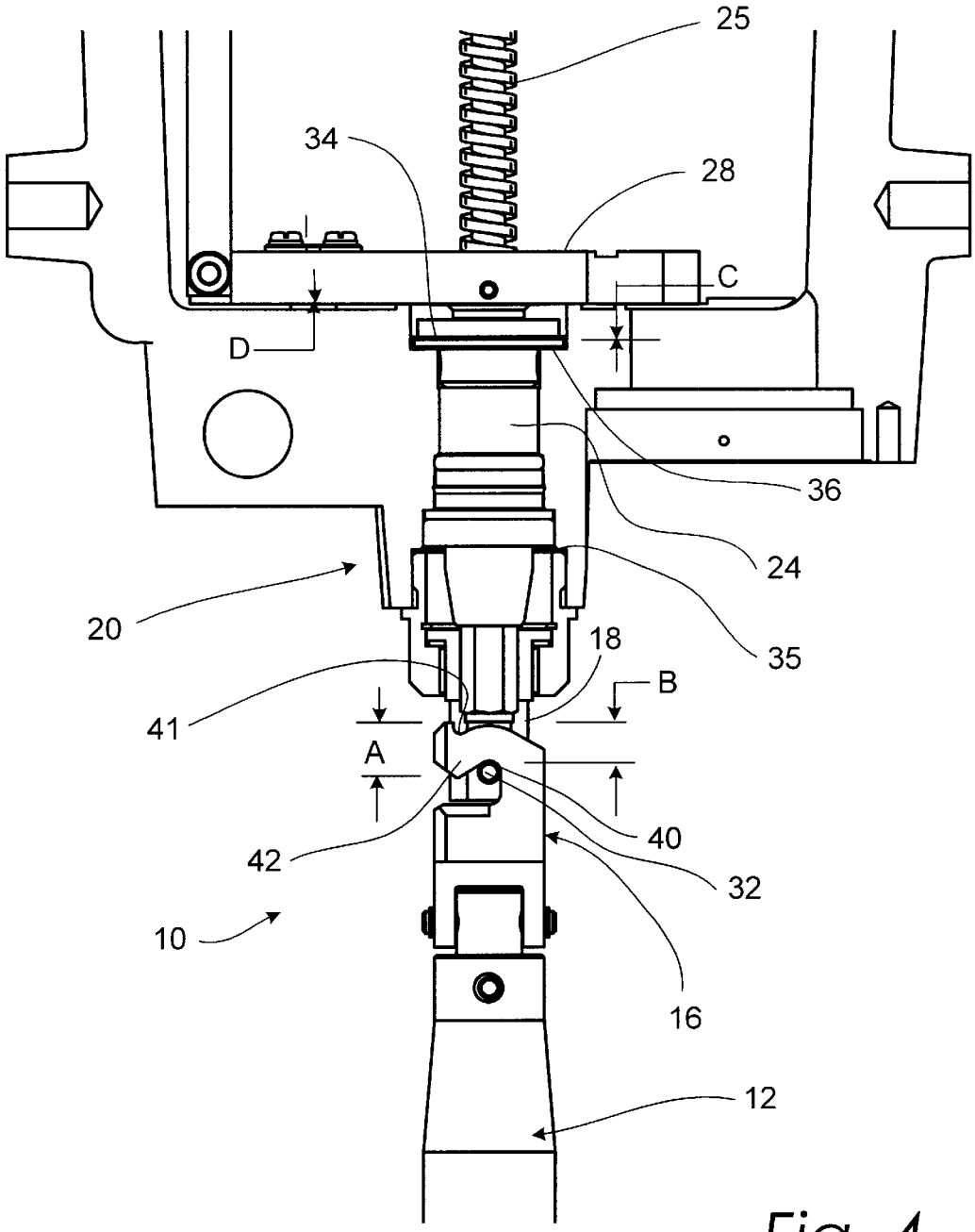

In FIG. 4, there is illustrated a second position, defined after a predetermined rotation of the tool 12 and the cooperating arrangement 18 with respect to the mechanism 14, e.g. one or more turns. Upon this second position being achieved, the tool 12 is retained and captive, i.e. the tool 12 cannot be removed until it is returned via rotation back to the first position. In a preferred embodiment, between the first and second positions, charging operation of the mechanism 14 does not yet begin, i.e. this may also be characterized as an initial attachment and retention step or phase with no relative movement or change in configuration of the internal components of the mechanism 14 that define the internal charging operation.

Figure 5:
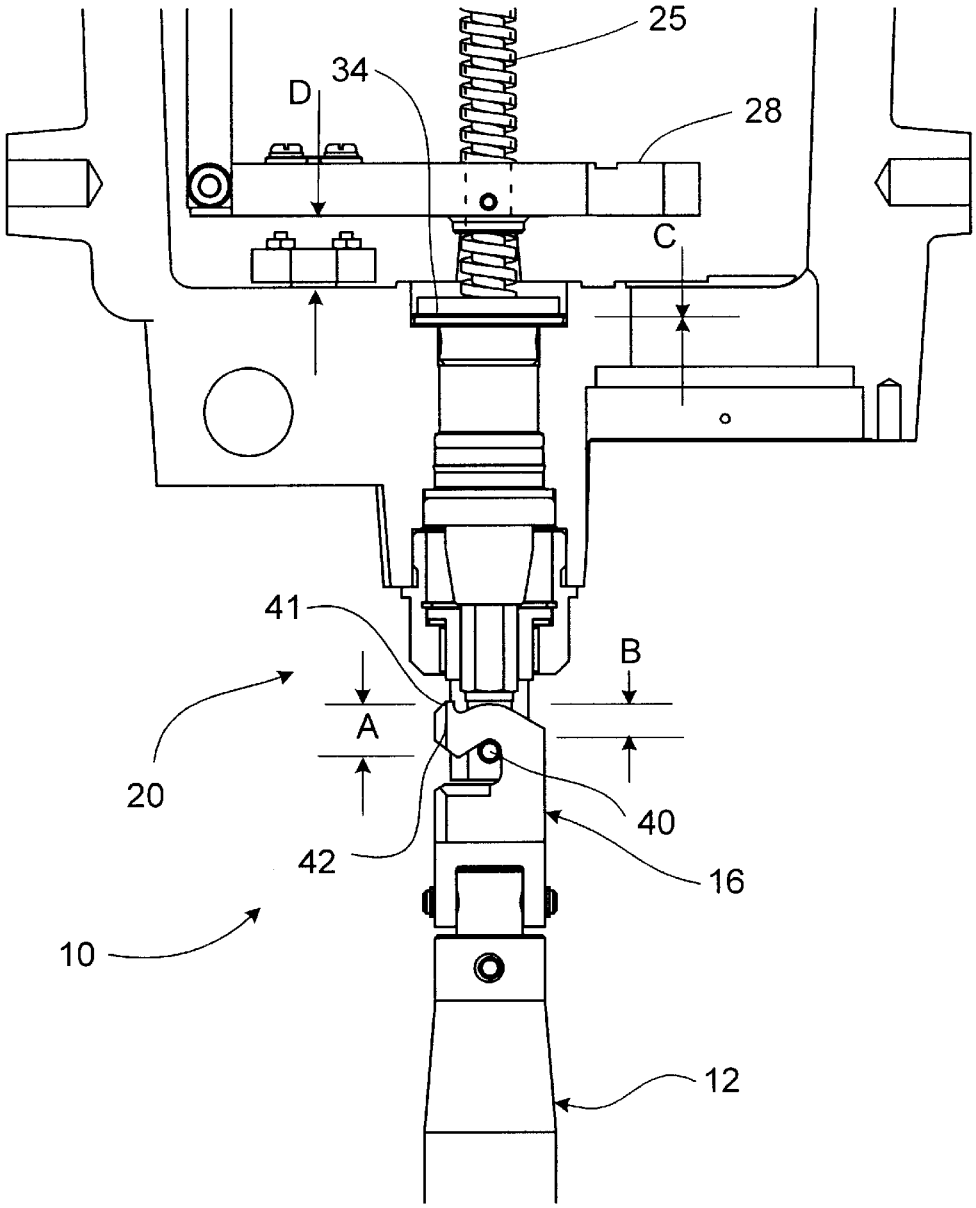

As the tool 12 is rotated beyond the second position, the charging of the mechanism 14 begins. For example, a third position, an intermediate charging position beyond the second position, is illustrated in FIG. 5. The charging operation is illustrated by the movement of a charging member 28 over the distance D. Charging operation continues until the charging member 28 has moved to a fully charged position (not shown) that is sufficient for fully charging the mechanism 14. The charging operation corresponds to a multi-turn operation of the tool 12, e.g. 30–35 turns in a specific embodiment. Upon reaching the fully charged position, rotation of the tool 12 in the charging direction is blocked. In order to remove the tool 12 from the mechanism 14, the tool 12 must be rotated in the reverse direction back through the third and second positions to the first position of FIG. 3. Until the first position is reached, the tool 12 cannot be removed from the charging port 18 of the operating arrangement 10. Accordingly, it should be noted that the retention of the tool 12 in the mechanism 14 indicates that the mechanism 14 is not fully charged and is in an intermediate position such that the associated circuit interrupter operated by the mechanism 14 is not in a closed operational state and the mechanism 14 is not ready for operation. Conversely, if the tool 12 is not attached to the mechanism 14, this indicates that the mechanism 14 is either fully charged or discharged and the associated circuit interrupter is either closed or open. Of course, as known in the prior art, indicators may be provided on the mechanism 14 to indicate the fully charged/closed and fully open/discharged operational states of the mechanism 14 and associated circuit interrupter.

Considering now the details of an illustrative embodiment of the present invention and with specific reference to FIG. 3, the operating arrangement 10 includes an input shaft 24 that is affixed to a charging screw 25 of the mechanism 14. The charging screw 25 is threaded into the charging member 28, e.g. a threaded nut. Rotation of the clevis coupler member 18 rotates the input shaft 24 through a sliding hexagon member 26. With the tool fitting 16 engaged over a pin 32 of the clevis coupler member 18, a rotation of the tool fitting 16 of one or more turns, e.g. 1-½ turns counterclockwise in a specific embodiment (from bottom of operating arrangement 10), moves the input shaft 24 away from the charging member 28, from the position of FIG. 3 to the position of FIG. 4, until a shoulder 34 of the input shaft 24 moves against a thrust washer 36 as illustrated in FIG. 4. A flat wire wave spring 35 biases the shoulder 34 to the thrust washer 36. The top of the hook portion 42 of the tool fitting 16 also includes an anti-removal notch at 41, this feature serving to block attempts to dislodge the tool fitting 16 from the mechanism 14 via upwardly or sideways forces exerted on the tool fitting 16.

In this second position, the tool 12 with the fitting 16 is captured as can be seen by the pin 32 being engaged within the bottom 40 of the hook portion 42 of the tool fitting 16. Continued counterclockwise rotation now raises the charging member 28 from the position of FIG. 4 through the position of FIG. 5, with the charging operation progressing until the charging member 28 is moved to a predetermined charged position. In addition to the operating arrangement 10 providing retention of the tool 12 during the charging operation, the mechanism 14 provides conversion of rotary movement of the tool 12 to linear motion of the charging member 28. That is, one or more turns of the tool 12 providing retention of the tool 12 by the mechanism 14 and linear motion of the charging member 28. With charging complete, the tool 12 may be rotated in the clockwise direction that returns through the positions of FIG. 5 to FIG. 4 to FIG. 3, whereupon the tool 12 is freed for removal.

Figure 6:
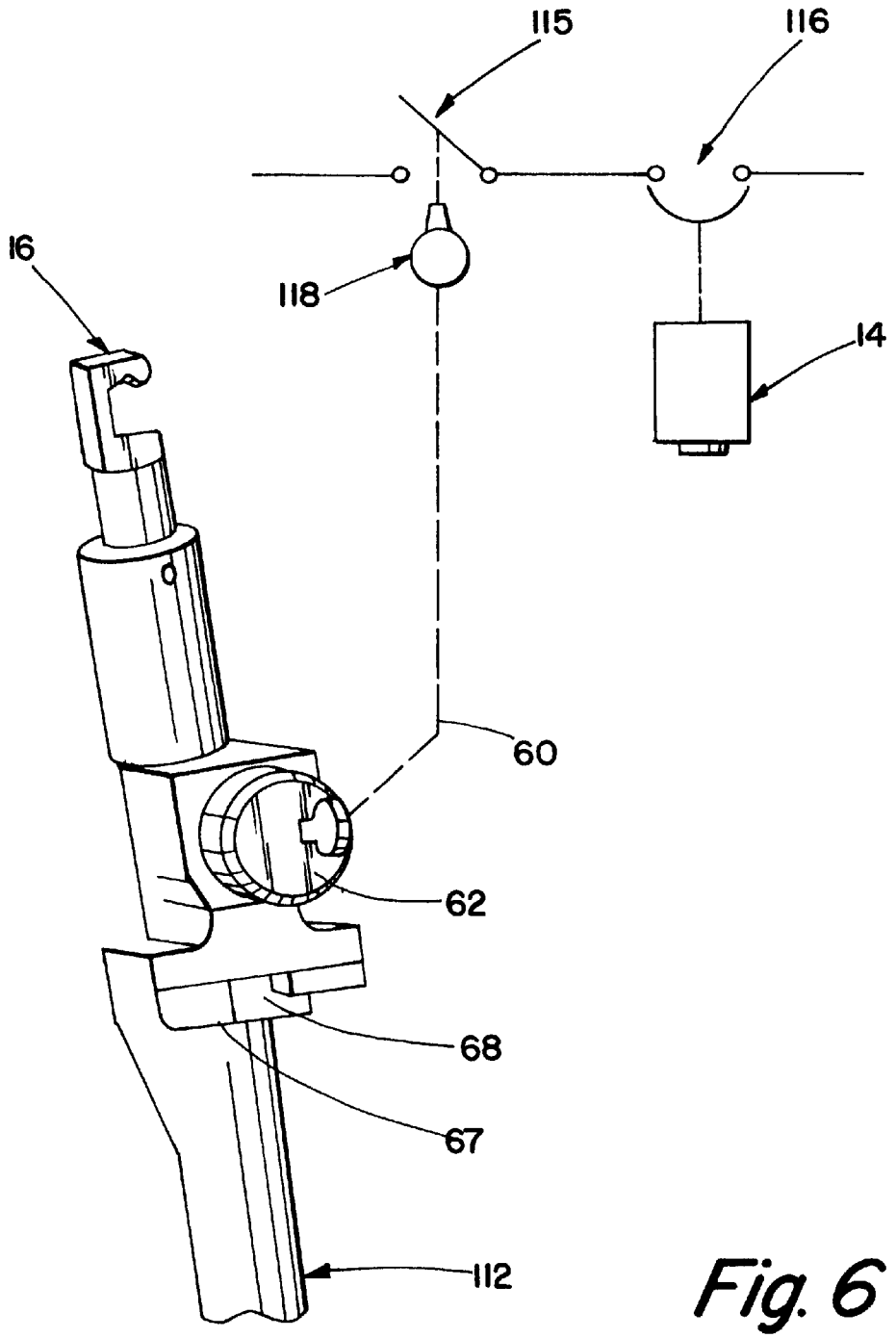
FIG. 6 is a perspective view of an alternate embodiment of the operating arrangement of FIGS. 1–5 in accordance with the present invention that provides an interlock function.
Figure 7:
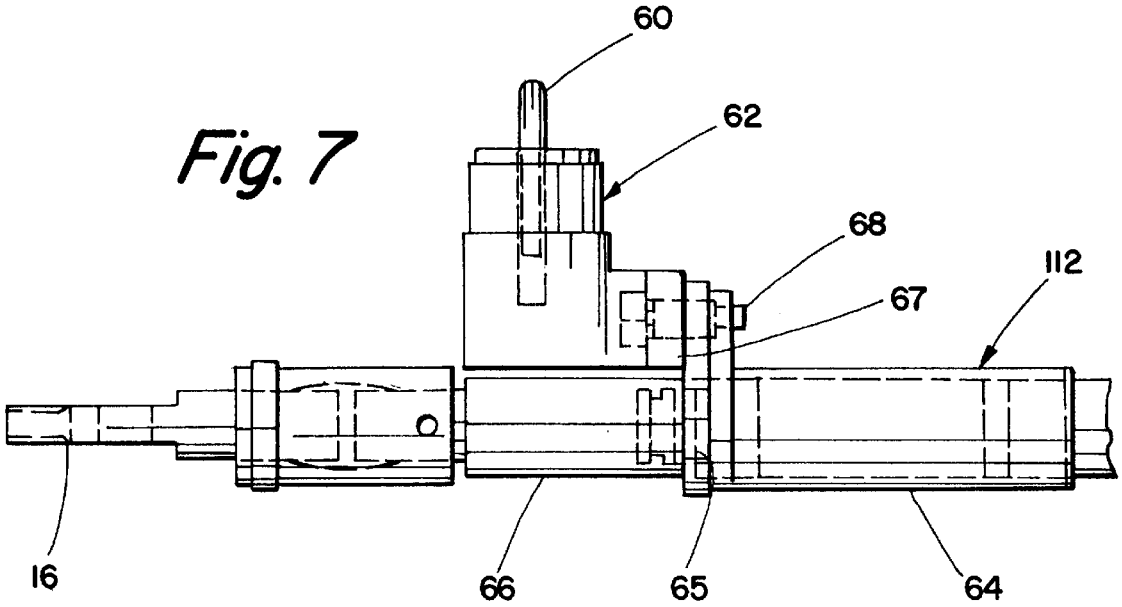
FIG. 7 is an elevational/sectional view of the operating arrangement of FIG. 6.
Figure 8:
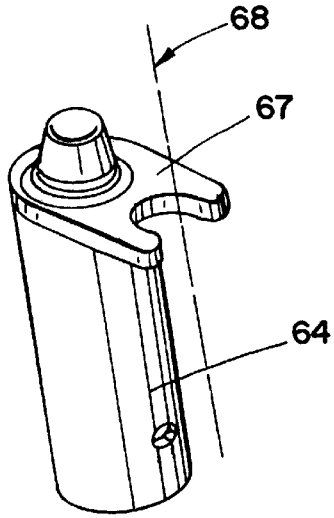
FIG. 8 is a perspective view of a portion of the operating arrangement of FIGS. 6 and 7.

Considering now other important features of the present invention and with reference to an alternative embodiment of the present invention and FIGS. 6–8, a tool 112 carrying the tool fitting 16 provides an interlock function to aid in ensuring appropriate sequenced operation of the operating arrangement 10 and an associated device, e.g. a disconnect switch 115 in series with an interrupter 116 controlled by the operating arrangement 10 and the mechanism 14. The associated disconnect switch 115 includes an interlock 118 that releases a key 60 only when the disconnect switch 115 is in a predetermined position, e.g. open. That is, with the disconnect switch 115 locked in a closed position by the interlock 118, the key 60 is captive and cannot be removed from the interlock 118. With the release of the key 60, the interlock 118 is arranged to disable operation of the disconnect switch 115 such that it remains locked in a desired position, e.g. open. The key 60 is utilized to control a locking mechanism 62 of the tool 112.

The locking mechanism 62 in a first predetermined operative state, in which the key 60 is inserted and turned to an active retained position, is arranged to transmit torque from movement of a lower tool portion 64 to an upper portion 66. In a second predetermined operative state, with the key turned to an inactive position in which the key 60 may be removed from the locking mechanism 62, the locking mechanism 62 does not transmit torque from the lower portion 64 to the upper portion 66 such that the operating arrangement 10 cannot be operated to charge the mechanism 14 and close an associated interrupter 116. In the first predetermined operative position, a bolt 68 is extended into a portion 67 of the lower portion 64, thus providing positive connection to the upper portion 66 such that the lower portion 64 may drive the upper portion 66. In the second predetermined position, the bolt 68 is withdrawn such that the upper portion 66 is not connected or is freewheeling from the lower portion 64. Thus, in an illustrative embodiment, the disconnect switch 115 is required to be locked open to release the key 60. The key 60 is then inserted into the locking mechanism 62 and operated such that the tool 112 may be utilized to charge the mechanism 14 via the operating arrangement 10. In a preferred arrangement, the upper portion 66 and the lower portion 64 are retained to each other via a tamper-resistant, one-way assembly device 65 (FIG. 7) that is implemented by a Smalley ring in a specific embodiment.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed is:

1. An operating arrangement for a mechanism comprising:

an operating member carrying first means;

second means carried by the mechanism and cooperating with said first means for retaining said operating member after engagement of said second means by said first means and predetermined manipulation of said first means to an initial position, said predetermined manipulation including one or more turns of said operating member via rotation of said operating member and said first means with respect to said mechanism.

2. The operating arrangement of claim 1 further comprising third means for charging the mechanism upon continued manipulation of said first means beyond said initial position with said second means continuing to retain said operating member.

3. The operating mechanism of claim 2 wherein said third means further comprises means for converting rotary movement of said operating member to linear movement for charging the mechanism.

4. The operating arrangement of claim 2 wherein said continued manipulation of said first means comprises multiple turns of said first means.

5. The operating arrangement of claim 1 wherein said operating member further comprises first and second portions and fourth means for providing selective coupling of said first and second portions.

6. The operating arrangement of claim 1 wherein said second means further comprises third means for converting rotation of said operating member into linear motion and charging the mechanism.

7. An operating arrangement for a mechanism comprising:

an operating member carrying first means;

second means carried by the mechanism and cooperating with said first means for retaining said operating member after engagement of said second means by said first means and predetermined manipulation of said first means to a first predetermined position; and third means for charging the mechanism as said first means is manipulated from said first predetermined position to a second predetermined position, said manipulation to said second predetermined position including multiple turns of said first means.

8. An operating arrangement for a mechanism comprising:

first means for providing an operating input;

second means carried by the mechanism and cooperating with said first means, said first and second means including third means carried by said first and second means for cooperating to provide captive engagement between said first and second means after said first means is manipulated to a first predetermined position relative to said second means including one or more turns of said first means relative to said second mean; and fourth means for charging the mechanism as said first means is manipulated from said first predetermined position to a second predetermined position, said third means being arranged to release said first means from said second means when said first means is manipulated back to said first predetermined position.

9. An operating tool comprising first and second portions and interlock means for selectively coupling said first and second portions whereby movement of said first portion is transmitted to said second portion, said interlock means comprising a key that is held captive in said operating tool when moved to an operative position for coupling said first and second portions, said key being released when moved to an operative position for decoupling said first and second portions.

10. An operating arrangement comprising;

an operating tool for a first circuit protective device including first and second portions and first interlock means for selectively coupling said first and second portions portions whereby movement of said first portion is transmitted to said second portion;

second interlock means for a second protective device connected in series electrical circuit with said first protective device;

third interlock operating means for operating said first and second interlock means, said first and second interlock means comprising fourth interlock operating means for locking said second protective device in a first predetermined operating position and releasing said third interlock means for use in operating said first interlock means and retaining said third interlock means in said first interlock means, said third interlock means being released from said second interlock means when said second protective device is locked in an open circuit position.

* * * * *